US010060257B2

(12) United States Patent
Douglas

(10) Patent No.: US 10,060,257 B2
(45) Date of Patent: Aug. 28, 2018

(54) DOWN-HOLE COMMUNICATION ACROSS A MUD MOTOR

(71) Applicant: Halliburton Energy Services, Inc., Houston, TX (US)

(72) Inventor: Hugh Douglas, Cheltenham (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 162 days.

(21) Appl. No.: 15/114,731

(22) PCT Filed: May 19, 2015

(86) PCT No.: PCT/US2015/031598
§ 371 (c)(1),
(2) Date: Jul. 27, 2016

(87) PCT Pub. No.: WO2016/186660
PCT Pub. Date: Nov. 24, 2016

(65) Prior Publication Data

US 2017/0145817 A1 May 25, 2017

(51) Int. Cl.

| | |
|---|---|
| ***E21B 47/18*** | (2012.01) |
| ***E21B 4/02*** | (2006.01) |
| ***E21B 4/00*** | (2006.01) |
| ***E21B 47/12*** | (2012.01) |

(52) U.S. Cl.
CPC ..... *E21B 47/18* (2013.01); *E21B 4/00* (2013.01); *E21B 4/02* (2013.01); *E21B 47/12* (2013.01)

(58) Field of Classification Search
CPC . E21B 47/12; E21B 47/18; E21B 4/00; E21B 4/02
See application file for complete search history.

(56) References Cited

U.S. PATENT DOCUMENTS 2,958,511 A * 11/1960 Pfefferle ..... E21B 4/02 175/107
3,077,937 A * 2/1963 Tiraspolsky ..... E21B 4/02 175/107

(Continued)

FOREIGN PATENT DOCUMENTS

WO WO 2002/029441 A1 4/2002

OTHER PUBLICATIONS

International Search Report and The Written Opinion of the International Search Authority, or the Declaration, dated Feb. 1, 2016, PCT/US2015/031598, 15 pages, ISA/KR.

*Primary Examiner* — Yong-Suk Ro

(57) ABSTRACT

Systems and methods of down-hole communication facilitate communication across a mud motor. The systems and methods can employ a hysteresis brake that selectively slows a turbine shaft to thereby produce local pressure pules in a drilling fluid in a predetermined pattern. The hysteresis brake can be operated by providing a relatively small control current to produce a relatively large counter torque, which can be transmitted the turbine shaft. The turbine and the hysteresis brake may be provided below a mud motor, and the local pressure pulses may be transmitted to a receiver disposed above the mud motor while the mud motor is operating. The hysteresis brake can be employed when other communication systems fail, and thus can provide a back-up system to permit a drilling operation to be continued.

14 Claims, 4 Drawing Sheets

(56) References Cited

U.S. PATENT DOCUMENTS

| | | | | |
|---|---|---|---|---|
| 3,867,714 | A * | 2/1975 | Patton | E21B 47/18 175/40 |
| 4,532,614 | A | 7/1985 | Peppers | |
| 4,562,560 | A | 12/1985 | Kamp | |
| 4,734,892 | A | 3/1988 | Kotlyar | |
| 5,197,040 | A | 3/1993 | Kotlyar | |
| 5,517,464 | A * | 5/1996 | Lerner | E21B 41/0085 175/45 |
| 6,092,610 | A | 7/2000 | Kosmala et al. | |
| 7,057,316 | B2 | 6/2006 | Spring | |
| 7,082,078 | B2 | 7/2006 | Fripp et al. | |
| 7,360,609 | B1 | 4/2008 | Falgout, Sr. | |
| 7,510,031 | B2 | 3/2009 | Russell et al. | |
| 7,681,663 | B2 | 3/2010 | Cobern | |
| 7,775,275 | B2 | 8/2010 | Patel | |
| 8,149,552 | B1 | 4/2012 | Cordill | |
| 8,720,608 | B2 | 5/2014 | Downton et al. | |
| 2004/0156265 | A1 | 8/2004 | Lavrut et al. | |
| 2006/0034154 | A1 | 2/2006 | Perry et al. | |
| 2010/0101781 | A1 | 4/2010 | Scholz | |
| 2011/0155466 | A1 | 6/2011 | Gibb et al. | |
| 2012/0000709 | A1 | 1/2012 | Farley et al. | |
| 2012/0085583 | A1 | 4/2012 | Logan et al. | |
| 2013/0000991 | A1 | 1/2013 | Scholz et al. | |
| 2013/0222149 | A1 | 8/2013 | Li et al. | |
| 2013/0292181 | A1 | 11/2013 | Blange et al. | |

* cited by examiner 22
10
30
28
52
50
38
36
"S"
"G"
12a
12
40
"X1"
18
12b
12c
100
14
44
46
34
32
40
42

DOWN-HOLE COMMUNICATION ACROSS A MUD MOTOR

BACKGROUND

1. Field of the Invention

The present disclosure relates generally to down-hole measurements related to oil and gas exploration and drilling operations. More particularly, embodiments of the disclosure relate to systems and methods for communicating data related the down-hole measurements from below a mud motor to destinations above the mud motor.

2. Background

Wellbores are often drilled through a geologic formation for hydrocarbon exploration and recovery operations. Measurements can be made in the wellbores related to various properties of the geologic formations, e.g., hardness, porosity, etc., and also to the properties of the wellbores themselves such as direction or inclination. Often, these measurements are made while the wellbores are being drilled. Systems for making these measurements during a drilling operation can be described as logging-while-drilling (LWD) or measurement-while-drilling (MWD) systems, and generally include various sensors carried by a bottom hole assembly (BHA) of a drill string. These measurements can be useful in steering a drilling apparatus, e.g., to maintain a predetermined path of a wellbore, and/or these measurements may be evaluated once the wellbore is complete for planning future operations.

At least some of the sensors of an LWD or MWD system may be disposed as near a down-hole end of the BHA as possible to provide measurements representative the conditions in which a drill bit is operating. Data provided by the sensors can be telemetered up-hole to a surface location or to other portions of the drill string by a telemetry tool located in the BHA. The telemetry tool may communicate with a variety of technologies including, e.g., mud pulse, electromagnetic and acoustic technologies. In some instances, a mud motor may be included in a BHA to drive the drill bit, and communication across the mud motor may be required between the sensors and the telemetry tool. A mud motor generally operates by turning a shaft in response to the passage of high pressure drilling fluid therethrough. Due in part to the rotational nature of a mud motor, transmission of information from the sensors disposed below the mud motor to a telemetry unit above the mud motor can be challenging. In some systems, a direct wired connection is passed through the mud motor to couple the sensors to the telemetry unit. The wires can be susceptible to erosion by the drilling fluid, and thus, the reliability of these systems can be limited. Other systems, such as "short-hop" electromagnetic systems, are used to communicate data across a mud motor. These systems may be adversely affected by electromagnetic properties of the geologic formation or by operation of the mud motor or other components of the BHA. Systems for transmitting data across a mud motor (in both up-hole and down-hole directions) remain lacking in the hydrocarbon drilling arts.

BRIEF DESCRIPTION OF THE DRAWINGS

The disclosure is described in detail hereinafter on the basis of embodiments represented in the accompanying figures, in which.

DETAILED DESCRIPTION

Figure 1:
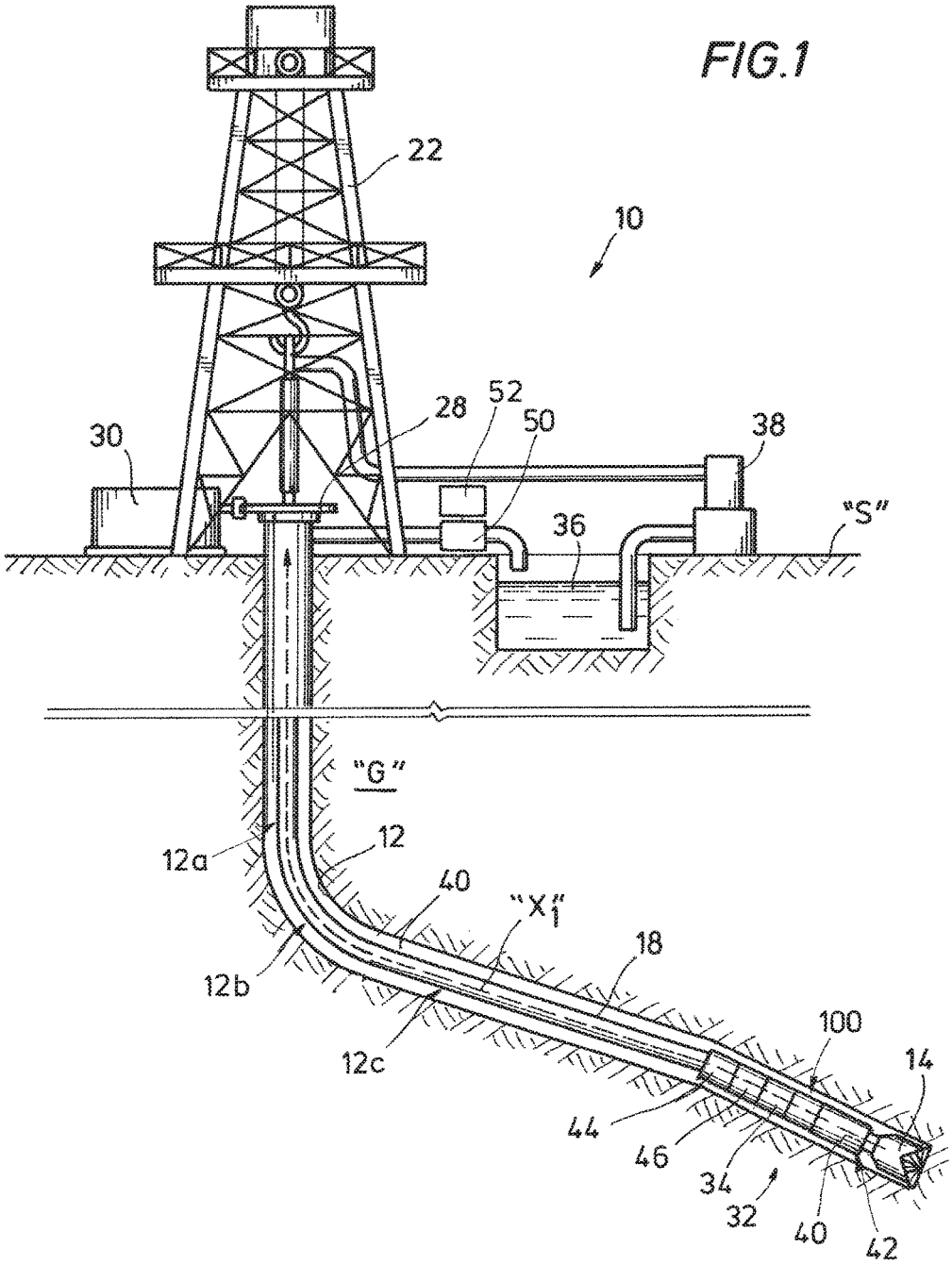
FIG. 1 is a cross-sectional schematic side-view of a drilling system including a BHA having a down-hole mud motor and a communication module for transmitting data across the mud motor in accordance with one or more exemplary embodiments of the disclosure.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, down-hole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the down-hole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a Figure may depict an onshore or terrestrial operation, it should be understood by those skilled in the art that the apparatus according to the present disclosure is equally well suited for use in offshore operations. Further, unless otherwise noted, even though a Figure may depict a wellbore that is partially cased, it should be understood by those skilled in the art that the apparatus according to the present disclosure may be equally well suited for use in fully open-hole wellbores.

1. Description of Exemplary Embodiments

Referring to FIG. 1, a directional drilling system 10 is illustrated that includes a down-hole communication module 100, in accordance with one or more embodiments of the present disclosure. Although directional drilling system 10 is illustrated in the context of a terrestrial drilling operation, it will be appreciated by those skilled in the art that aspects of the disclosure may also be practiced in connection with offshore platforms and or other types of hydrocarbon exploration and recovery systems as well.

Directional drilling system 10 is partially disposed within a directional wellbore 12 traversing a geologic formation "G." The directional wellbore 12 extends from a surface location "S" along a curved longitudinal axis $X_1$. In some exemplary embodiments, the longitudinal axis $X_1$ includes a vertical section 12*a*, a build section 12*b* and a tangent section 12*c*. The tangent section 12*c* is the deepest section of the wellbore 12, and generally exhibits lower build rates (changes in the inclination of the wellbore 12) than the build section 12*b*. In some exemplary embodiments (not shown), the tangent section 12*c* is generally horizontal. Additionally, in one or more other exemplary embodiments, the wellbore 12 includes a wide variety of vertical, directional, deviated, slanted and/or horizontal portions therein, and may extend along any trajectory through the geologic formation "G."

A rotary drill bit 14 is provided at a down-hole location in the wellbore 12 (illustrated in the tangent section 12*c*) for cutting into the geologic formation "G." When rotated, the drill bit 14 operates to break up and generally disintegrate the geological formation "G." At the surface location "S" a drilling rig 22 is provided to facilitate rotation of the drill bit 14 and drilling of the wellbore 12. The drilling rig 22 includes a turntable 28 that generally rotates the drill string 18 and the drill bit 14 together about the longitudinal axis $X_1$. The turntable 28 is selectively driven by an engine 30, chain drive system or other or other apparatus. Rotation of the drill string 18 and the drill bit 14 together may generally be referred to as drilling in a "rotating mode," which maintains the directional heading of the rotary drill bit 14 and serves to produce a straight section of the wellbore 12, e.g., vertical section 12*a* and tangent section 12*c*.

In contrast, a "sliding mode" may be employed to change the direction of the rotary drill bit 14 and thereby produce a curved section of the wellbore 12, e.g., build section 12*b*. To operate in sliding mode, the turn table 28 may be locked such that the drill string 18 does not rotate about the longitudinal axis $X_1$, and the rotary drill bit 14 may be rotated with respect to the drill string 18. To facilitate rotation of the rotary drill bit 14 with respect to the drill string 18, a bottom hole assembly or BHA 32 is provided in the drill string 18 at a down-hole location in the wellbore 12.

In the illustrated embodiments, the BHA 32 includes a mud motor 34 that generates torque in response to the circulation of a drilling fluid, such as mud 36, therethrough. The mud 36 can be pumped down-hole by mud pump 38 through an interior of the drill string 18. The mud 36 passes through the BHA 32 including the mud motor 34, which extracts energy from the mud 36 to turn the rotary drill bit 14. As the mud 36 passes through the BHA 32, the mud 36 may also lubricate bearings (not explicitly shown) defined therein before being expelled through nozzles (not explicitly shown) defined in the rotary drill bit 14. The mud 36 lubricates the rotary drill bit 14 and flushes geologic cuttings from the path of the rotary drill bit 14. The mud 36 is then returned through an annulus 40 defined between the drill string 18 and the geologic formation "G." The geologic cuttings and other debris are carried by the mud 36 to the surface location "S" where the cuttings and debris can be removed from the mud stream.

In accordance with some exemplary embodiments of the disclosure, the BHA 32 includes drilling tool 40 disposed down-hole of the mud motor 34. The drilling tool 40 may include components for operating the rotary drill bit 14 such as bearing assemblies (not shown) or steering mechanisms (not shown) to facilitate the directional drilling of the wellbore 12. The drilling tool 40 may carry a feedback device 42 thereon for measuring a parameter of the down-hole environment at a location near the rotary drill bit 14. In some exemplary embodiments, the feedback device 42 may include accelerometers, inclinometers, thermometers or other types of sensors for measuring characteristics of the wellbore 12. Also, in some exemplary embodiments, the feedback device 42 may include radiation detectors, acoustic detectors, electromagnetic detectors or other devices for measuring characteristics of the geologic formation "G" near the rotary drill bit 14. In other exemplary embodiments, the feedback device 42 may measure an operational characteristic of the BHA 32 such as a rotational speed of the rotary drill bit 14. In still other exemplary embodiments, the particular parameter measured by the feedback device 42 may not be related to a drilling operation, and therefore, the exemplary embodiments of the feedback device 42 should not be considered limiting.

The BHA 32 may also include a data collection tool 44, such as an MWD tool or a LWD tool, disposed up-hole of the mud-motor 34. The data collection tool 44 is operable to measure, process, and/or store information therein. The data collection tool 44 may include devices (not explicitly shown) for measuring a weight on the rotary drill bit 14, for measuring a resistive torque applied to the BHA 32 by the geologic formation "G," for measuring vibrational energy and/or for measuring any other parameters associated with MWD or LWD tools as recognized by those skilled in the art.

The data collection tool 44 is operatively coupled to a telemetry tool 46, which is also disposed up-hole of the mud motor 34. In exemplary embodiments, the telemetry tool 46 can include and employ any type of telemetry system or any combination of telemetry systems, such as electromagnetic, acoustic and or wired drill pipe telemetry systems for two-way communication with the surface location "S" or with other portions of the drill string 18. The telemetry tool 46 may transmit data collected from the data collection tool 44 and/or feedback device 42 in an up-hole direction, and may also receive instructions or data transmitted in a down-hole direction from the surface location "S," for example. In the exemplary embodiments illustrated FIG. 1, the telemetry tool 46 comprises a mud pulse telemetry system that is operable generate disturbances in a column of mud 36 in the wellbore 12 that can be detected by an up-hole receiver 50 disposed at the surface location "S." The up-hole receiver 50 is operable to detect and measure pressure changes in mud 36, and is illustrated as being in fluid communication with mud 36 in the annulus 40. However, as one skilled in the art will appreciate, the up-hole receiver 50 may additionally or alternatively be fluidly coupled to mud 36 within the drill string 18. The up-hole receiver 50 is communicatively coupled to a processing unit 52 that is operable to receive, interpret and analyze signals detected by the up-hole receiver 50.

The down-hole communication module 100 is provided for communicating across the mud motor 34. As described in greater detail below, in some exemplary embodiments, the communication module 100 may be operable to receive data from the feedback device 42, and then to transmit the data to the telemetry tool 46 on an opposite side of the mud motor 34. The telemetry tool 46 may receive the transmission from the communication module 100, and then, in turn, transmit the information up-hole to the surface location "S."

Figure 2:
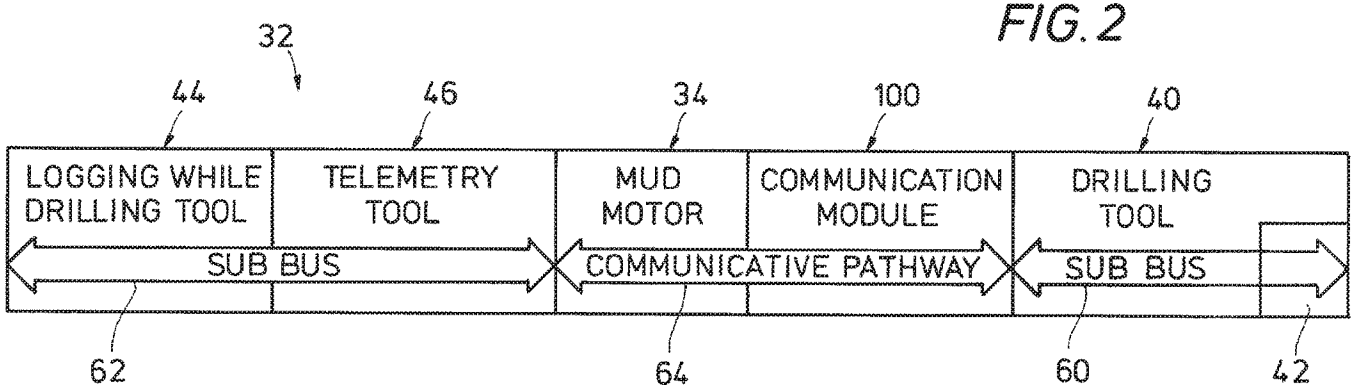
FIG. 2 is a schematic view of the BHA of FIG. 1 illustrating communication pathways defined within the BHA.

Referring to FIG. 2, a communications network within the BHA 32 is illustrated. A first sub bus 60 extends along the drilling tool 40 and provides a communicative pathway for data provided by the feedback device 42 to reach the communication module 100. A second sub bus 62 extends along the data collection tool 44 and the telemetry tool 46, and provides a communicative pathway for data collected by the data collection tool 62 to reach the telemetry tool 46. The communication module 100 provides a communicative pathway 64 that bridges the first sub bus 60 and second sub bus 62. Communication may thus be established along the entire BHA 32 through the first sub bus 60, second sub bus 64 and communicative pathway 64. Communication into and out of the BHA 46 may be established with the telemetry tool 46.

Figure 3:
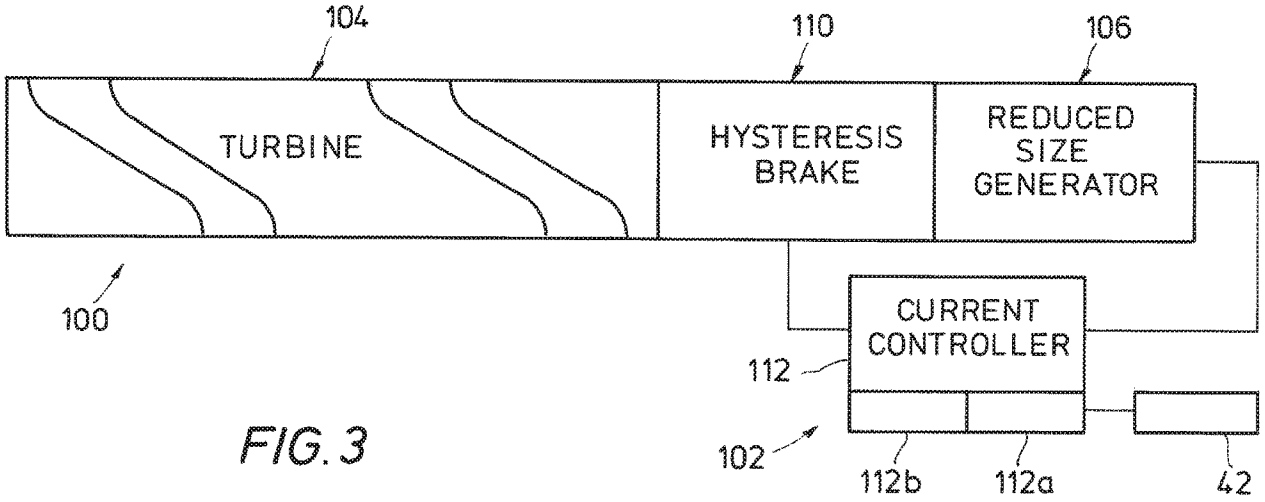
FIG. 3 is schematic block diagram of the communication module of FIG. 1 illustrating a mechanical braking system disposed between a turbine and a generator of the communication) module.
Figure 4:
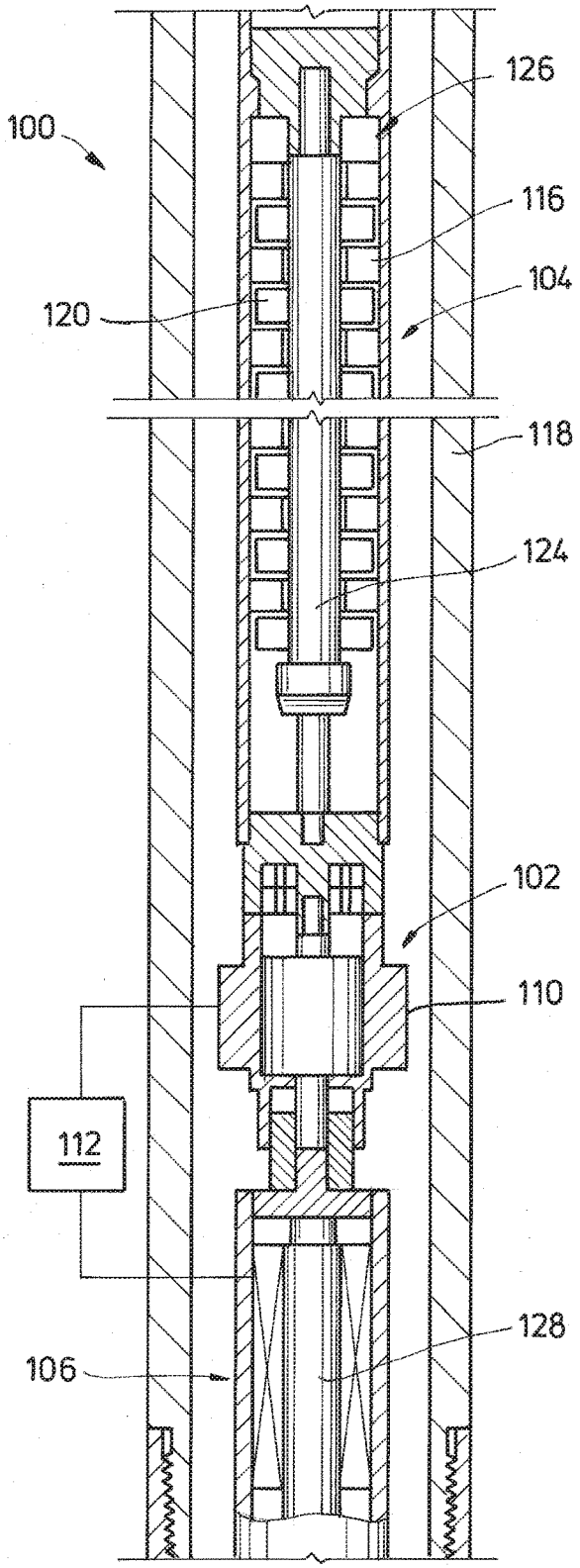
FIG. 4 is a cross-sectional schematic side-view of the communication module of FIGS. 1 and 3.

Referring now to FIGS. 3 and 4, the communication module 100 includes a braking system 102 operatively coupled between a turbine 104 and a generator 106. The braking system 102 includes a braking component 110 and a controller 112 that is operable to provide instructions to the braking component 110 as described in greater detail below.

In some exemplary embodiments, the turbine 104 can be a positive-displacement pump, sometimes referred to as a Moineau-type pump. The turbine 104 includes a stator 116, which is mounted in a stationary manner with respect to an outer housing 118. A rotor 120 is rotationally supported within the stator 116 and includes a turbine shaft 124. The stator 116 and the rotor 120 are shaped such that movement of the mud 36 (FIG. 1) through a central flow passage 126 induces rotation of the rotor 120 with respect to the stator 116. The rotor 120 extracts hydraulic energy from the circulation of the mud 36 (FIG. 1) through the turbine 104, and converts the hydraulic energy into mechanical rotational movement of the turbine shaft 124. The turbine shaft 124 can be operatively coupled to a generator shaft 128 through the braking component 110 such that the generator shaft 128 receives the rotational motion from the turbine shaft 124. Rotation of the generator shaft 128 produces an electric voltage that can be used to power down-hole electronics such as feedback device 42 and controller 112.

The braking system 102 is selectively operable limit the rotational speed of the turbine shaft 124 and generator shaft 128. By changing the rotational speed of the turbine shaft 124, local pressure variations will be produced in the mud 36 (FIG. 1), which can be detected and/or decoded by the telemetry tool 46 (FIG. 2). In some exemplary embodiments, the braking component of the 110 can include a mechanical brake that is operable to generate frictional forces that produce a counter-torque to retard the rotational motion in the turbine shaft 124. In other exemplary embodiments, the braking component 110 includes a hysteresis brake. A hysteresis brake generally includes internal magnets (not shown) that are responsive to an input current or a control current from the controller 112 to vary an output torque. The output torque can be applied to the counter the rotational motion of the turbine shaft 124. Since there is no frictional contact between the magnets of a hysteresis brake, a hysteresis brake is generally durable and can provide consistent torque without producing large quantities of heat, which can be difficult to dissipate in a down-hole environment.

In some exemplary embodiments, the controller 112 of the braking system 102 can include a computer having a processor 112*a* and a computer readable medium 112*b* operably coupled thereto. The computer readable medium 112*b* can include a nonvolatile or non-transitory memory with data and instructions that are accessible to the processor 112*a* and executable thereby. In one or more embodiments, the computer readable medium 112*b* is pre-programmed with a set of instructions for encoding data received from the feedback device 42 into a sequence of pressure pulses. The processor 112*a* can execute the instructions to appropriately provide the input current to the hysteresis brake of braking component 110 to thereby slow the turbine shaft 124 and produce the sequence of pressure pulses in the mud 36 (FIG. 1).

In the exemplary embodiments illustrated in FIGS. 3 and 4, the generator 106 is arranged to provide electrical power to the controller 112 and feedback device 42. The electrical output of the generator 106 may be relatively small since the hysteresis brake of the braking system 102 requires a relatively small amount of power to produce the necessary counter-torque to slow the turbine 104. In other embodiments, electrical power can be provided by a battery or other down-hole power sources as recognized in the art. In some exemplary embodiments, the drilling tool 40 may include an internal turbine and generator (not shown) that provides electrical power to the feedback device 42.

2. Example Implementation

Figure 5:
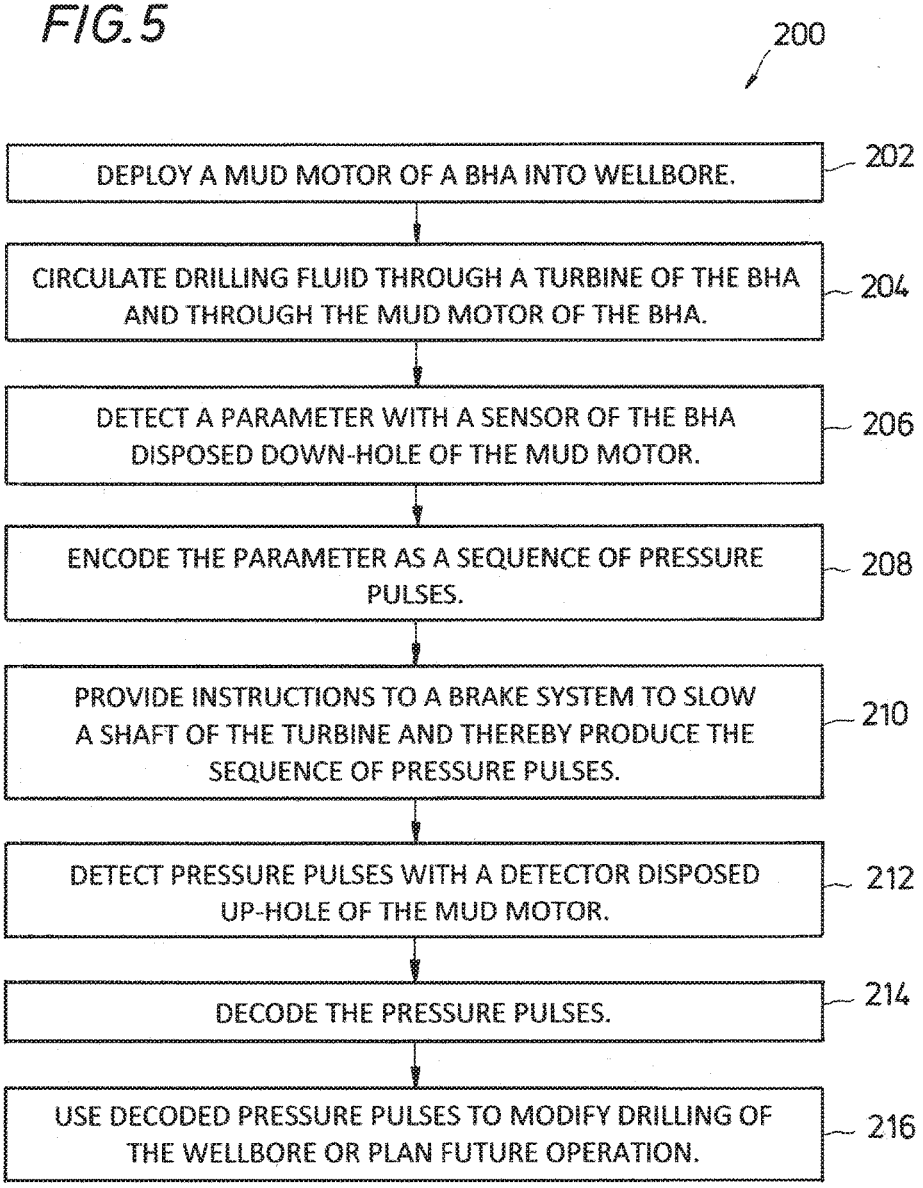
FIG. 5 is a flowchart illustrating operational procedures employing the down-hole communication modules of FIGS. 3 and 4.

Referring now to FIG. 5, and with reference to FIGS. 1 through 4, exemplary embodiments of an operational procedure 200 are described that employ the communication module 100 described above. Initially at step 202, the BHA 32 is deployed into the wellbore 12, and drilling mud 36 is circulated through the turbine 104 and mud motor 34 (step 204). Circulation of the mud 36 through the mud motor 34 induces rotational motion in the turbine shaft 124 and the mud motor 34, which can hinder communication through the mud motor 34 with conventional mechanisms. At step 206, a parameter of the wellbore 12, geologic formation "G" or the BHA 32 can be detected by the feedback device 42. Since the feedback device 42 is disposed down-hole of the mud motor 34, communication of data provided by the feedback device 42 may be transmitted across the mud motor 34 with the communication module 100.

The controller 112 receives data from the feedback device 42 and encodes the data as a series of pressure pulses (step 208). Next, at step 210, the controller 112 can provide instructions to the braking component 110 to provide a counter-torque to the turbine shaft 124 in an appropriate pattern to slow the turbine shaft 124 in a manner that produces the sequence of pressure pulses in the mud 36. The pressure pulses travel up the wellbore 12 across the mud motor 34 and can be detected by a detector disposed up-hole of the mud motor 34 (step 212). In some exemplary embodiments, the pressure pulses can be detected by the telemetry tool 46, which can decode the pressure pulses (step 214) and transmit signals representative of the data provided by the feedback device 42 to the surface location "S." In some other exemplary embodiments, the pressure pulses can be detected directly by the up-hole receiver 50, which is disposed at the surface location "S." The pressure pulses can then de decoded by the processing unit 52.

In some exemplary embodiments, at step 216 the decoded pressure pulses can be employed to modify drilling of the wellbore 12, e.g., to alter a directional heading of the rotary drill bit 14. In other embodiments, the decoded pressure pulses may be stored and accumulated to plan future exploration or drilling operations.

In some exemplary embodiments, the communication module 100 may be employed when an independent communication system (not shown) experiences a failure or when communication by conventional means becomes unavailable. Additionally, in some embodiments, the communication module 100 can be deployed in the wellbore 12 in alternate locations, e.g., on drill string 18 above the a mud motor 34, or on another other work string (not shown) that does not include a mud motor 34.

3. Aspects of the Disclosure

In one aspect, the disclosure is directed to a down-hole communication module. The down-hole communication module includes a turbine responsive to the circulation of drilling fluid therethrough to generate rotational motion in a turbine shaft thereof, and also includes a braking system selectively operable to transmit a counter-torque from the braking system to the turbine shaft to retard the rotational motion in the turbine shaft. The braking system includes a braking component coupled to the turbine shaft and a controller operable to provide instructions to the braking component to provide the counter torque the turbine shaft in a predetermined pattern.

In some exemplary embodiments, the braking component includes a hysteresis brake, and in some embodiments, the down-hole communication module further includes an electrical generator operably coupled to the turbine shaft to receive rotational motion from the turbine shaft and to produce electrical power from the rotational motion. In one or more exemplary embodiments, the controller is operatively coupled to the electrical generator to receive electrical power therefrom.

In one or more exemplary embodiments, the down-hole communication module further includes a feedback device operatively coupled to the controller, and the controller includes instructions stored thereon to encode data provided by the feedback device as a series of pressure pulses and to provide the instructions to the baking component based on encoded data. The feedback device may be operable to measure at least parameter of at least one of a wellbore in which the feedback device is disposed, a geologic formation in which the feedback device is disposed, and an operational characteristic of a bottom hole assembly in which the feedback device is disposed. In some exemplary embodiments, the braking component comprises a mechanical braking component operable to produce frictional forces therein to produce the counter torque in the turbine shaft.

In another aspect, the disclosure is directed to a bottom hole assembly that includes a mud motor responsive to the circulation of drilling fluid there through to induce rotational motion in a rotary drill bit. The bottom hole assembly also includes a feedback device disposed below the mud motor that is operative to measure a parameter of a down-hole environment in the vicinity of the rotary drill bit, and a turbine disposed below the mud motor that is responsive to the circulation of the drilling fluid therethrough to generate rotational motion in a turbine shaft thereof. The bottom hole assembly further includes a braking system selectively operable to transmit a counter-torque from the braking system to the turbine shaft to retard the rotational motion in the turbine shaft in a pattern representative of the parameter measurable by the feedback device.

In one or more exemplary embodiments, the braking system comprises a hysteresis brake, and in some exemplary embodiments, the bottom hole assembly further includes a telemetry tool disposed above the mud motor. The telemetry tool may be operable to receive and decode pressure pulses generated by the braking system. In some exemplary embodiments, the telemetry tool is communicatively coupled to a data acquisition tool disposed above the mud motor, and the data acquisition tool includes at least one of an MWD tool and a LWD tool.

In another aspect, the disclosure is directed to a method of communicating in a wellbore including (a) circulating a drilling fluid through a turbine disposed in the wellbore to generate rotational motion in a turbine shaft of the turbine, (b) transmitting a counter-torque to the turbine shaft in a predetermined pattern from a braking system coupled to the turbine shaft to thereby generate pressure pulses in the drilling fluid, and (c) detecting the pressure pulses with a receiver in fluid communication with the drilling fluid.

In some exemplary embodiments, the braking system includes a hysteresis brake, and transmitting the counter torque to the turbine shaft includes applying a control current to the hysteresis brake in a predetermined pattern. In one or more exemplary embodiments, the method further includes operating a mud motor disposed between the turbine and the receiver while transmitting the counter torque to the turbine shaft.

In one or more exemplary embodiments, the method further includes measuring a down-hole parameter with a feedback device communicatively coupled to the braking system, and transmitting the counter-torque to the turbine shaft includes transmitting the counter torque in a turbine shaft in a pattern representative of the parameter detected. In some exemplary embodiments, the method further includes adjusting a parameter of a drilling operation responsive to receiving a signal representative of the parameter detected.

Moreover, any of the methods described herein may be embodied within a system including electronic processing circuitry to implement any of the methods, or a in a computer-program product including instructions which, when executed by at least one processor, causes the processor to perform any of the methods described herein.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A down-hole communication module for coupling below a mud motor in a bottom hole assembly, the communication module, comprising:

a feedback device operable to measure a down-hole parameter below the mud motor;

a turbine responsive to circulation of drilling fluid through the turbine to generate rotational motion in a turbine shaft of the turbine; and a braking system selectively operable to transmit a counter-torque from the braking system to the turbine shaft to retard the rotational motion in the turbine shaft, the braking system comprising:

a braking component coupled to the turbine shaft; and a controller operable to receive data representative of the down-hole parameter from the feedback device, to encode the data representative of the down-hole parameter as a series of pressure pulses detectable across the mud motor, and to provide instructions to the braking component to provide the counter torque the turbine shaft in a predetermined pattern to produce the series of pressure pulses in the drilling fluid.

2. The down-hole communication module of claim 1, wherein braking component comprises a hysteresis brake.

3. The down-hole communication module of claim 2, further comprising an electrical generator operably coupled to the turbine shaft to receive rotational motion from the turbine shaft and to produce electrical power from the rotational motion.

4. The down-hole communication module of claim 3, wherein the controller is operatively coupled to the electrical generator to receive electrical power from the electrical generator.

5. The down-hole communication module of claim 1, wherein the feedback device is operable to measure at least parameter of at least one of a wellbore in which the feedback device is disposed, a geologic formation in which the feedback device is disposed, and an operational characteristic of a bottom hole assembly in which the feedback device is disposed.

6. The down-hole communication module of claim 1, wherein the braking component comprises a mechanical braking component operable to produce frictional forces in the braking component to produce the counter torque in the turbine shaft.

7. A bottom hole assembly comprising:

a mud motor responsive to circulation of drilling fluid there through to induce rotational motion in a rotary drill bit;

a feedback device disposed below the mud motor, the feedback device operative to measure a parameter of a down-hole environment in the vicinity of the rotary drill bit;

a turbine disposed below the mud motor, the turbine responsive to the circulation of the drilling fluid therethrough to generate rotational motion in a turbine shaft thereof;

a controller including instructions stored thereon to encode data representative of the parameter as a series of pressure pulses, and to provide instructions to produce the series of pressure pulses in the drilling fluid based on the encoded data; and a braking system selectively operable to receive the instructions to produce the series of pressure pulses and to transmit a counter-torque from the braking system to the turbine shaft to retard the rotational motion in the turbine shaft in a pattern to produce the series of pressure pulses representative of the parameter in the drilling fluid.

8. The bottom hole assembly of claim 7, wherein the braking system comprises a hysteresis brake.

9. The bottom hole assembly of claim 7, further comprising a telemetry tool disposed above the mud motor, wherein the telemetry tool is operable to receive and decode pressure pulses generated by the braking system.

10. The bottom hole assembly of claim 9, wherein the telemetry tool is communicatively coupled to a data acquisition tool disposed above the mud motor, and wherein the data acquisition tool comprises at least one of an MWD tool and a LWD tool.

11. A method of communicating in a wellbore, the method comprising:

deploying a bottom hole assembly into a wellbore, the bottom hole assembly including a mud motor, a turbine below the mud motor and a receiver above the mud motor;

circulating a drilling fluid through the turbine to generate rotational motion in a turbine shaft of the turbine;

measuring a down-hole parameter with a feedback device below the mud motor;

encoding data representative of the down-hole parameter as a series of pressure pulses with a controller;

instructing a breaking system with the controller to slow the shaft of the turbine in a pattern predetermined to produce the series of pressure pulses;

transmitting a counter-torque to the turbine shaft with the break system in the predetermined pattern to thereby generate pressure pulses in the drilling fluid;

detecting the pressure pulses with the receiver above the mud motor and in fluid communication with the drilling fluid; and decoding the pressure pulses above the mud motor.

12. The method of claim 11, wherein the braking system comprises a hysteresis brake; and wherein transmitting the counter torque to the turbine shaft comprises applying a control current to the hysteresis brake in a predetermined pattern.

13. The method of claim 11, further comprising operating the mud motor while transmitting the counter torque to the turbine shaft.

14. The method of claim 11, further comprising adjusting a parameter of a drilling operation responsive to decoding the pressure pulses.

* * * * *